United States Patent [19]

Barlow

[11] Patent Number: 4,970,792

[45] Date of Patent: Nov. 20, 1990

[54] DRAWING MACHINE

[75] Inventor: Gordon A. Barlow, Highland Park, Ill.

[73] Assignee: Gordon Barlow Design, Skokie, Ill.

[21] Appl. No.: 496,347

[22] Filed: Mar. 20, 1990

[51] Int. Cl.[5] ..... B43L 11/00

[52] U.S. Cl. ..... 33/27.11

[58] Field of Search ..... 33/27.11, 26, 27.01

[56] References Cited

U.S. PATENT DOCUMENTS 4,825,556 5/1989 Goldfarb ..... 33/27.11

*Primary Examiner*—Harry N. Haroian

*Attorney, Agent, or Firm*—Kinzer, Plyer, Dorn, McEachran & Jambor

[57] ABSTRACT

A manually-actuated drawing toy including a pair of beams linked for alternate, reciprocal motion, each beam of the beams having at least one holder for a writing implement. A rectangular tray is provided to hold a piece of drawing paper under and in contact with the writing implements. A mechanism is provided to rotate the paper tray eccentrically as the beams are alternately reciprocated. The paper tray may be rotated and held in different positions relative to the path of movement of the beams.

3 Claims, 2 Drawing Sheets

DRAWING MACHINE

BACKGROUND AND SUMMARY OF THE INVENTION

A drawing machine utilizing writing implements such as marking pens, which machine is simple enough for use by a child but will produce sophisticated drawings when used by a skilled operator.

An object of this invention is a drawing machine that can utilize one to four marking implements at a time.

Another object of this invention is a drawing machine which is operated by the reciprocating movement of two beams which carry the writing implements.

Another object of this invention is a drawing machine in which the reciprocating movement of the beams which carry the writing implements also rotate the tray holding the paper on which the writing implements write.

Another object of this invention is a drawing machine in which a paper holding tray is located eccentrically to its axis of rotation during drawing.

Another object of this invention is a drawing machine in which the orientation of the paper holding tray relative to the reciprocal movement of the writing implements may be varied.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
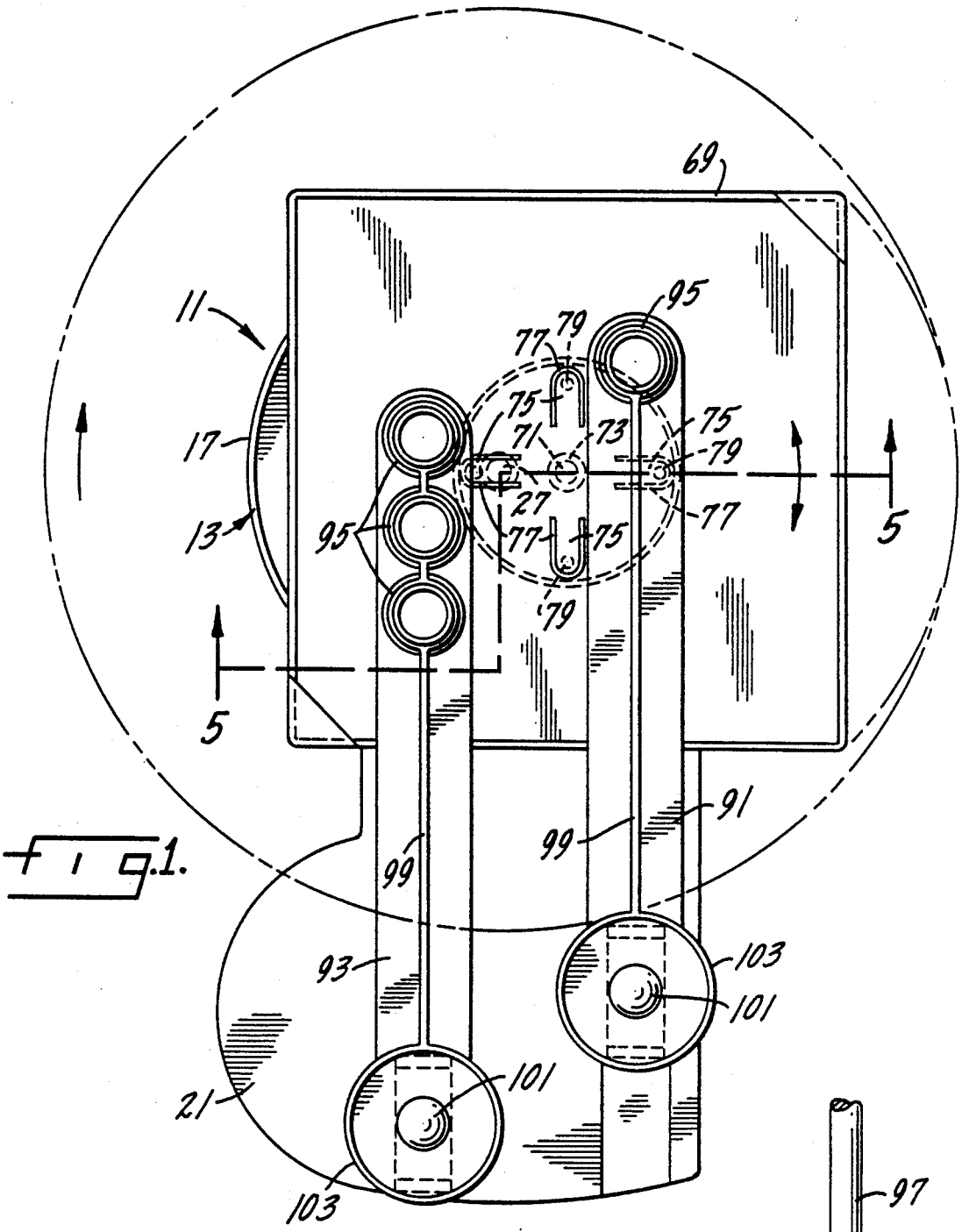
FIG. 1 is a top plan view of the drawing machine of this invention, with some parts shown in hidden lines.
Figure 3:
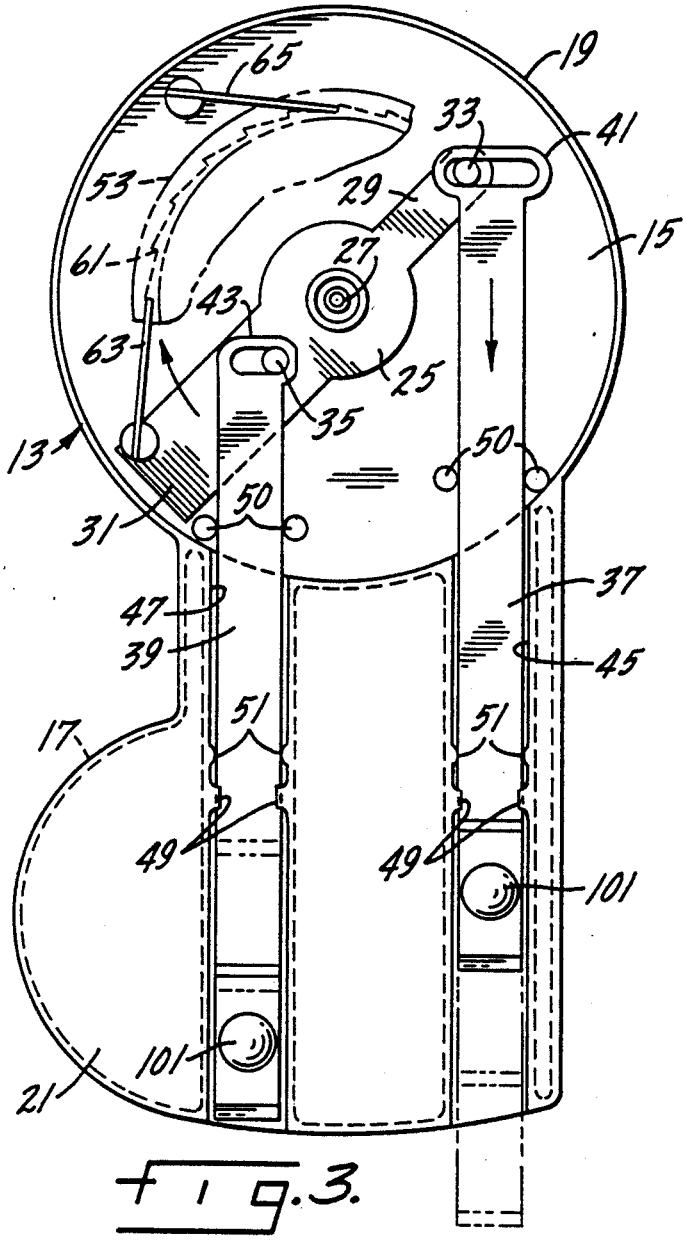
FIG. 3 is a top plan view of the base of the drawing machine with some parts removed, some shown in phantom and others broken away, all for clarity of illustration.
Figure 4:
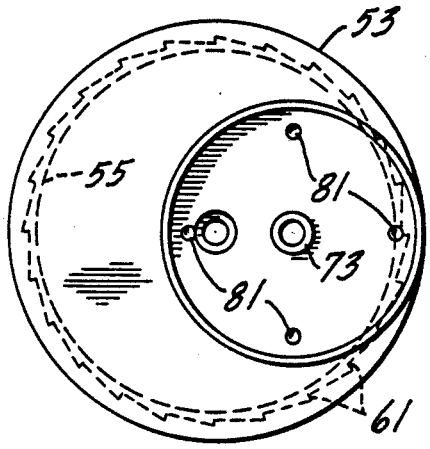
FIG. 4 is a top plan view of the turntable mechanism of the drawing instruments, with some parts shown in hidden lines.

FIG. 1 of the drawings shows a drawing machine 11 embodying the novel features of this invention. The drawing machine 11 includes an irregularly-shaped, shallow, dish-like base 13, shown most clearly in FIGS. 3 and 5 of the drawings, having a thin bottom wall 15 and thin side walls 17, all formed preferably of a single piece of plastic. The base includes a circular portion 19 formed integrally with an elongated portion 21.

A crank 25 is mounted for rotation about a post 27 formed integrally with the bottom wall 15. The crank includes a narrow arm 29 and a wider arm 31 diametrically opposed to each other. Upstanding drive posts 33 and 35 are formed respectively on the arms 29 and 31. A pair of actuating beams 37 and 39, each having a loop 41 and 43, respectively, at an end thereof, which loops engage the drive posts 33 and 35 to rotate the crank 25. The actuating beams 37 and 39 ride in channels 45 and 47 formed in the elongated portion 21 of the base 13 and are held in position by tabs 49 and guide posts 50. Additionally, protrusions 51 engage the edges of the reciprocating beams for alignment purposes.

Figure 5:
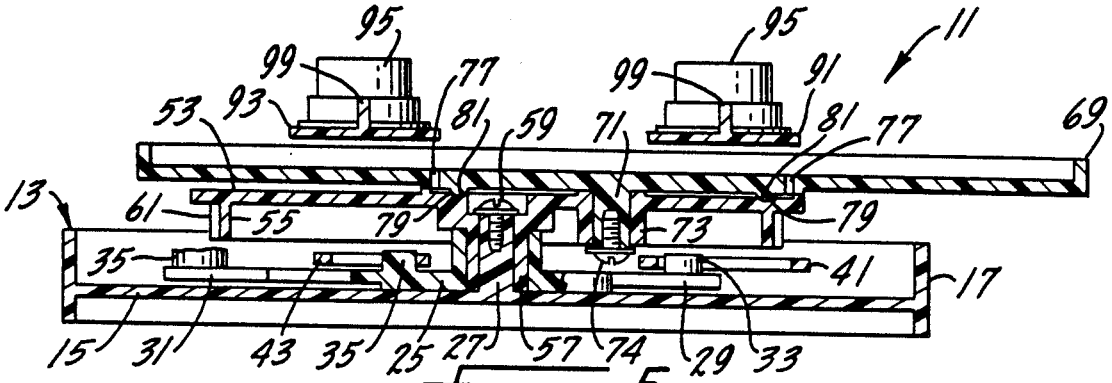
FIG. 5 is a cross-sectional view taken along line 5—5 of FIG. 1.

A turntable 53, shown in cross-section in FIG. 5 of the drawings, has a downwardly-extending, peripherally-located flange 55. It also has a sleeve 57 which telescopes over the post 27, with a screw 59 seated in the post to hold the turntable in position. Ratchet teeth 61 are formed on the outside of the peripheral sleeve 55 and are engaged by a metal drive finger 63 carried on the wide arm 31 of the crank 25 to drive the turntable. An anti-backlash finger 65 is mounted on the bottom wall 15 of the circular portion 19 of the base to engage the ratchet teeth 61 and prevent counterclockwise rotation of the turntable, as viewed in FIGS. 1 and 3 of the drawings.

As best seen in FIGS. 1 and 5 of the drawings, a rectangular paper tray 69 having an integral, downwardly-projecting center post 71 is journaled in a sleeve 73 formed integrally with the turntable 53 and located radially outwardly of the center of rotation of the turntable 53. A screw 74 holds the paper tray in position.

Four flexible fingers 75 are formed in the bottom wall of the paper tray by U-shaped notches 77, with the fingers located ninety degrees relative to one another. Downwardly-extending projections 79 are formed near the tips of these fingers and fit into recesses 81 formed in the upper surface of the turntable 53 to provide a detent means for holding the paper tray 69 in various positions of rotation.

Figure 2:
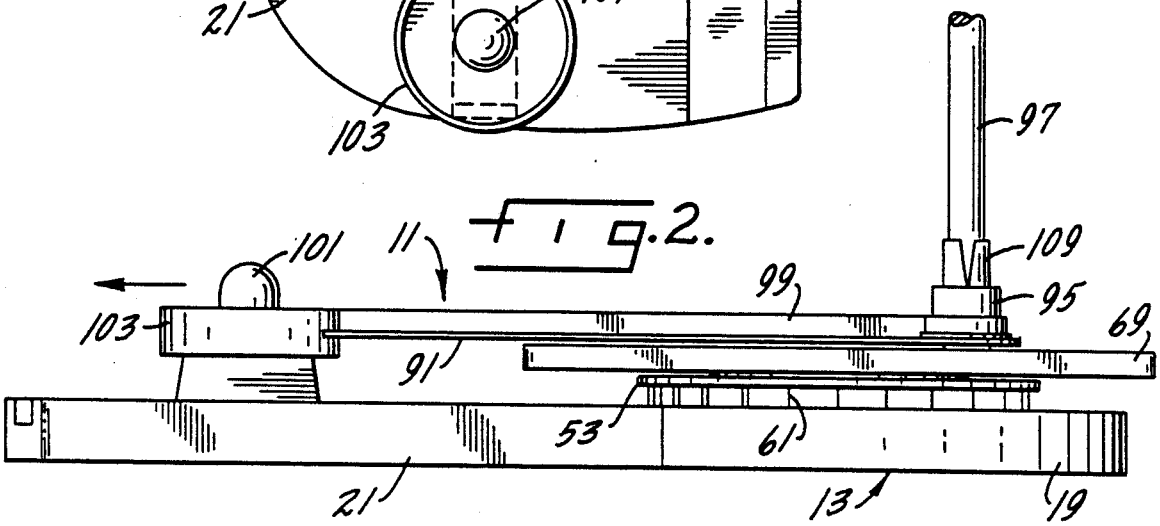
FIG. 2 is a side elevational view of the drawing machine of FIG. 1, as viewed from the right side, with background omitted for clarity.

Upper beams 91 and 93, shown most clearly in FIGS. 1, 2 and 5 of the drawings, each include one or more tubular holders 95 for carrying writing implements 97. These upper beams are reinforced by upstanding ribs 99 extending along the length thereof. A dowel 101 extends between each set of upper beams 91, 93 and lower beams 37, 39 to connect the set of upper and lower beams for movement in unison. Knobs 103 at the ends of the upper beam remote from the tubular holders 95 are provided for ease in reciprocating the upper beams.

The writing implements 97 each fit into a sleeve 109 having annular ribs, not shown, which support the writing implement in the tubular holder 95. As shown in the drawings, the upper beam 93 has three tubular holders, while the upper beam 91 has a single tubular holder. It should be appreciated, of course, that this arrangement of tubular holders can be varied without departing from the scope of this invention. The implement holding sleeves 109 are notched at the upper ends to provide flexibility in holding writing implements of various diameters.

When the upper beams 91 and 93 are reciprocated, the writing implements 97 held in the tubular holders 95 at the ends of the beams will write on a piece of paper held in the rectangular paper tray 69. Reciprocation of the upper beams 91, 93 will also reciprocate the lower beams 37, 39, which in turn will rotate the crank 25 and, through the finger 63 and ratchet teeth 61, will rotate the turntable 53 in a clockwise direction, as viewed in FIGS. 1 and 3 of the drawings. Since the center of the rectangular paper tray 69 is offset relative to the center of rotation of the turntable 53, the reciprocating motion of the drawing implements in the tubular holders of the upper and lower beams will create an irregular pattern of lines on the sheet of paper held in the rectangular paper tray. Once a drawing is complete with a paper tray 69 in one detained position of rotation, it is possible to rotate the paper tray relative to the turntable by applying pressure to the tray so that the projections 79 on its fingers 75 will be forced out of the recesses 81 in the turntable so that the paper tray can be turned ninety degrees to another detent position of the paper tray relative to the turntable.

I claim:

1. A manually-actuated drawing toy, including:

a pair of beams linked for alternate, reciprocal motion, at least one of said beams having means to hold at least one writing implement, a rectangular tray for holding a piece of drawing paper under and in contact with said writing instrument, and means to rotate said rectangular tray eccentrically as said beams are alternately reciprocated.

2. The drawing toy of claim 1 further including means to rotate said rectangular tray about its center and to detain said tray in predetermined positions of rotation relative to the path of reciprocal motion of the beams.

3. The drawing toy of claim 1 further characterized in that said means to rotate said rectangular paper tray eccentrically as said beams are reciprocated include:

a crank having diametrically-opposed arms, pin and slot means connecting said beams to said crank arms, a turntable pivotally mounted for rotation about the central axis of said crank arm, ratchet teeth formed on the periphery of said turntable, and a finger mounted on said crank and engaging said ratchet teeth to drive said turntable, said rectangular tray being mounted on said turntable eccentrically relative to the pivotal mounting of said turntable.

* * * * *